US005838077A

United States Patent [19]

Chelcun et al.

[11] Patent Number: 5,838,077

[45] Date of Patent: Nov. 17, 1998

[54] CONTROL SYSTEM FOR SWITCHING LOADS ON ZERO CROSSING

[75] Inventors: Darrell N. Chelcun, Buffalo Grove; James H. Gu, Wheeling, both of Ill.

[73] Assignee: Pittway Corporation, Chicago, Ill.

[21] Appl. No.: 501,396

[22] Filed: Jul. 12, 1995

[51] Int. Cl.[6] ..... H01H 35/00

[52] U.S. Cl. ..... 307/130; 307/125; 307/126; 307/132 EA; 304/492

[58] Field of Search ..... 364/492; 307/125–132 EA, 307/139–141.4; 323/235, 319, 323, 299, 300

[56] References Cited

U.S. PATENT DOCUMENTS

| | | | |
|---|---|---|---|
| 5,055,962 | 10/1991 | Peterson et al. | 361/187 |
| 5,473,202 | 12/1995 | Mudge et al. | 307/116 |
| 5,488,565 | 1/1996 | Kennon et al. | 364/483 |

OTHER PUBLICATIONS

Catalog page, Aromat Heavy Duty Lighting Control Relay, Hid Relay, undate.

Specification page, Sensor Switch, Inc., Wallingford Conn., dated revised Oct. 1992.

*Primary Examiner*—William M. Shoop, Jr.
*Assistant Examiner*—Kim Lockett
*Attorney, Agent, or Firm*—Dressler, Rockey, Milnamow & Katz, Ltd.

[57] ABSTRACT

An AC load switching system predicts when a zero voltage cross-over condition will exist for purposes of switching an AC load to minimize inrush currents. Prediction is carried out by characterizing the switching devices, which preferably are electromechanical in nature, and determining closure and bounce delays associated with each type of switching device. The system includes a processor, which could be a programmed microprocessor. The processor stores characterization parameters for the load switching elements including closure delay time as well as bounce time intervals. The processor energizes a switching element to close same at a time during the AC line cycle such that when the delay interval has passed and one half of the bounce interval has passed, the line voltage will be at a cross-over or zero voltage condition thereby resulting in minimal inrush current when the contacts have completely closed. Multi-phased loads can be switched at respective zero voltage cross-over conditions by adjusting load switching element energizing times by the delay of each of the respective phases. In a 60 hertz 3 phase system the delays are adjusted by 5.55 and 11.11 milliseconds from a reference phase.

18 Claims, 3 Drawing Sheets

CONTROL SYSTEM FOR SWITCHING LOADS ON ZERO CROSSING

FIELD OF INVENTION

The invention pertains to the field of AC load control. More particularly, the invention pertains to switching systems for controlling sources of illumination, such as florescent fixtures.

BACKGROUND OF THE INVENTION

Building management systems and lighting control systems are designed to switch many types of high voltage AC loads from 120 VAC to 480 VAC in building applications. Such applications include HVAC and lighting controls.

These high voltage AC loads can be either capacitive or inductive by nature and, as such, current spikes in the form of inrush currents occur at turn on or turn off times, respectively. These inrush currents can substantially reduce the life span of a mechanical switching element. In severe cases, the contacts of the switching element can be welded together.

In modern building control systems, large numbers of florescent tubes need to be switched on and off in accordance with normal work day schedules.

The use of electronic ballasts in connection with florescent lights results in lower overall operating costs due to the fact that such ballasts can function properly at lower power levels than conventional ballasts. Electronic ballasts however, generally have a capacitive input impedance.

One of the characteristics of a capacitive input impedance is that voltage across the input terminals of the device cannot change instantaneously but current can. As a result, when an AC voltage is switched across a capacitive input impedance, high inrush currents often result as the capacitive input impedance instantaneously behaves like a short circuit. As the voltage builds up across the capacitive input impedance, the current returns to normal operating levels.

The desire to use electronic ballasts, as opposed to older conventional ballasts to achieve lower operating costs, has resulted in a need for switching systems which can be used with large numbers of electronic ballasts and which can cost effectively deal with the inrush currents associated with large numbers of electronic ballasts which may be switched on or off at the same time.

Testing has shown that switching these loads at the voltage zero cross of the phase being switched, reduces or eliminates the inrush current. What further complicates the implementation of voltage wave zero cross switching in a 277 VAC lighting system is that all 3 phases of the 277 VAC power system are controlled from the same panel. Each phase would have to be monitored and synchronized to provide the necessary time reference for the voltage wave zero cross.

Prior attempts to solve the above-identified problems have met with only limited success. One known prior solution is to use solid state switching devices. However, in view of the high currents and voltages involved, along with the inrush currents, appropriate semi-conductor switches tend to be too expensive to be cost-effective in this application. Another attempted solution has been to combine a solid state switch, such as a triac in parallel with an electromechanical relay for the purpose of absorbing the inrush currents.

Yet another solution which has only been partially successful is to use heavy-duty relays which are rated and intended for use with lighting control systems where high inrush currents are present due to the use of electronic ballasts.

Thus, it would be desirable to be able to provide for switching of all types of loads whether resistive, capacitive or inductive in response to a zero crossing of the associated voltage. Preferably, such systems could be used with all forms of electromechanical switching elements including mechanical latching relays, normally open relays, electronic relays or solenoid actuated breakers. Further, it would desirable if such switching systems address the inrush current associated with highly capacitive electronic ballasts so as to minimize contact welding in electromechanical switching elements.

SUMMARY OF THE INVENTION

A system for switching a varying voltage to a load wherein the switching element is an electromechanical device, such as a relay, includes a control unit coupled to the switching element. The control unit can include a programmable processor.

A circuit is coupled to the control unit wherein a first parameter of the switching element can be stored. For example, one parameter of particular interest is the time delay between when an electrical signal is applied to the switching element and when the contacts first close.

A second parameter of interest is the bounce time interval.

During the bounce time interval the load switching contacts of the switching element may open and close for short periods of time. In one aspect of the invention, the second parameter is also stored.

A circuit is coupled to the control unit for detecting when the varying voltage exhibits a zero crossing. When the control unit detects the zero crossing event, assuming that a load circuit associated with that varying voltage is to be switched on, the control unit determines when the next zero crossing is to be expected and subtracts from the intervening time interval the device delay time and one-half of the device contact bounce time interval.

The switching element is then energized by the control unit prior to the next zero crossing such that the switching element is half-way through its bounce time interval when the next zero crossing takes place. This will then minimize the inrush current to which the current carrying contacts of the switching element are exposed.

In the event that a plurality of loads are energized from three phase alternating voltage and current, where a multiple phase load is to be switched, assuming all three switching elements are identical, the second and the third phases can be switched similarly by simply adding the appropriate phase delay. This delay is on the order of 5.5 milliseconds for a three phase, 60 hertz system.

In yet another aspect, a method of switching a load, being energized by an AC-type signal, includes the steps of:

determining the characteristics of the load switching element including a time delay between when a signal is applied to the switching element to cause it to close and when the element initially closes as well as a second parameter which defines a bounce time interval;

detecting a zero crossing of the applied AC-type signal;

energizing the switching element a sufficient time before the next zero crossing occurs such that the switching element will begin to close at or about the time of the next zero crossing; and switching any other phases in accordance with the offset between phases.

In yet another aspect, the programmable processor can be implemented as a commercially available microcomputer.

The switching element parameters can be stored in a read-only memory or a read-write memory and accessed as required.

The programmable processor can be energized off of a reference phase of a multiple phase system. Each of the other phases can be switched, based on detecting zero crossings of the reference phase, by adding to the switching time of the reference phase, a phase delay corresponding to the phase difference between each of the subsequent phases and the reference phase. Hence, in accordance with this embodiment of the invention, the programmable control unit need only be coupled to the reference phase and detect zero crossings thereof in order to be able to provide controllable zero crossing switching for all phases.

DETAILED DESCRIPTION OF PREFERRED EMBODIMENT

Figure 1:
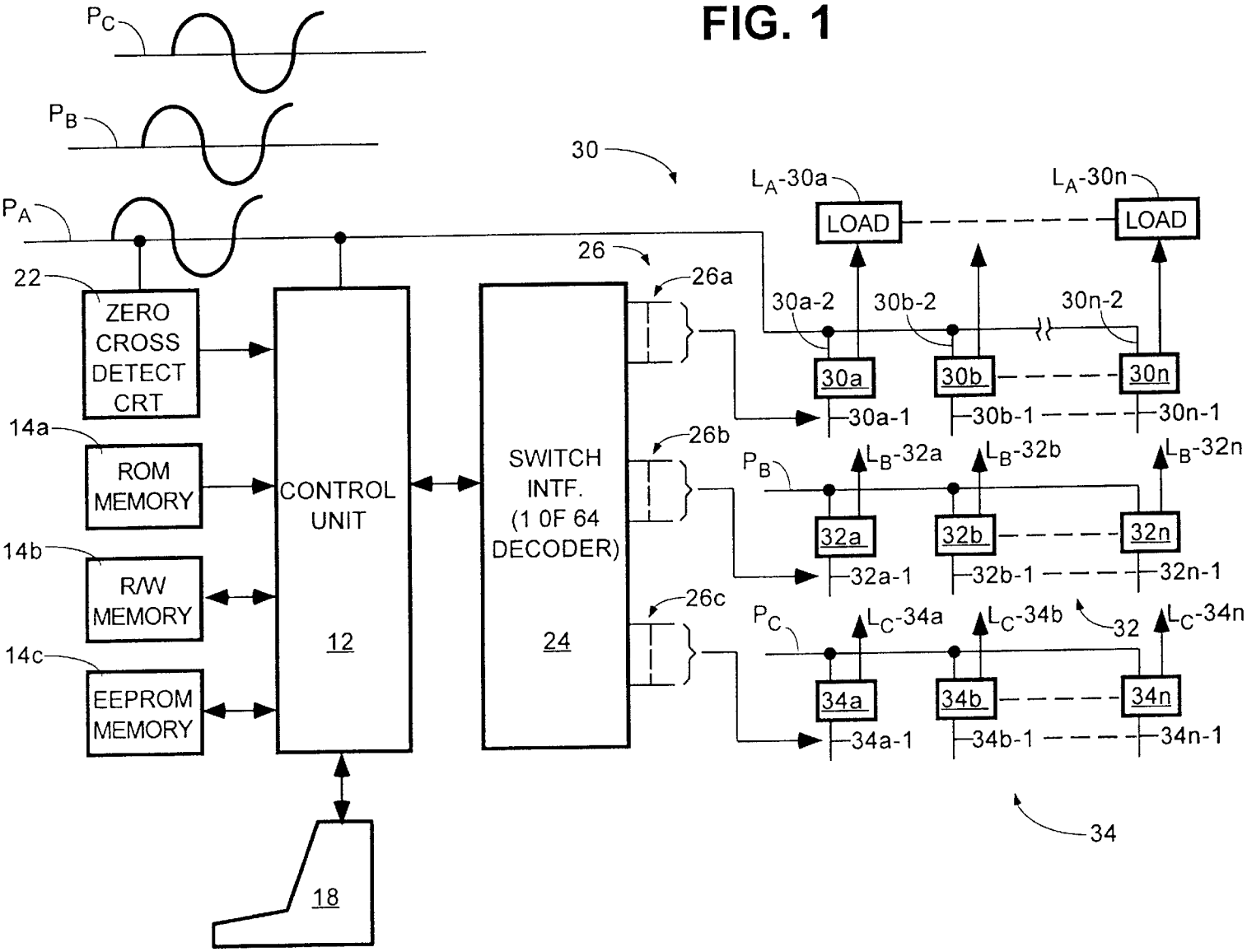
FIG. 1 is an overall block diagram of a system usable to control a three-phase load.

While this invention is susceptible of embodiment in many different forms, there are shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 illustrates, in block diagram form, a system 10 which is in accordance with the present invention. The system 10 includes a control unit 12. The control unit 12 can be implementable as any one of a plurality of commercially available programmable microprocessors. The control unit 12 could also be implemented as a hard-wired, programmed logic array without departing from the spirit and scope of the present invention.

The control unit 12, when implemented as a microprocessor, has associated therewith read-only memory 14*a* wherein control programs can be permanently stored and read-write memory 14*b* wherein parameters, current data and intermediate results can be stored. If desired, those parameters which are needed on a long-term basis can be stored in programmable read-only memory 14*c* which can be implemented as electrically erasable programmable read-only memory. For purposes of operator control, a terminal including key board and display unit 18 can be provided, coupled through an appropriate interface, to the control unit 12.

The system 10 can be energized off of a single, reference phase, $P_A$ of a three-phase system which could be for example 60 hertz, 227 volts AC or the like. Three-phase loads can be switched using the system 10 and energized off of the three available phases $P_AP_BP_C$. The system 10 however need only be coupled directly to one of the phases, such as $P_A$, notwithstanding it may be controlling switching for the other two phases as well.

The system 10 can be used to switch single phase loads or three-phase loads, depending on the requirements. Irrespective of the type of load being switched, the system 10 is always energized off of a single, reference, phase. Coupled to the control unit 12 is a zero crossing detector circuit 22. The detector circuit 22 generates an interrupt at the control unit 12 each time the reference phase, $P_A$, crosses zero. Since each of phases $P_B$ and $P_C$ are 120 degrees apart from each other, zero crossings for those phases occur, in a 60 hertz system, on the order of 5.5 and 11.11 milliseconds respectively after a zero crossing has been detected on the reference phase, $P_A$.

Coupled to the control unit 12 is a switching interface 24 which could be implemented as a one of 64 decoder. The switching interface 24 converts a multiple bit, such as an 8 bit, binary code to one of 64 output lines indicated generally at 26.

Each of the decoded output lines can be coupled to a control signal input for a switching element indicated in each of pluralities 30, 32 and 34.

The members of the plurality 30 could for example, be latching relays or solenoid actuated breakers. In either event, the respective switching element, such as the element 30*a* has a control input 30*a*-1, a high power AC input, such as 30*a*-2 and a switched output 30*a*-3.

The control input 30*a*-1 could be connected, via appropriate interface, as would be known to those of skill in the art to a selected output line of the decoder 24. When the element 30*a* has been selected, an appropriate pulse of electrical energy is applied at the control input 30*a*-1, so as to cause the element 30*a* to change state and electromechanically correct the input AC power, illustrate connected to the reference phase $P_A$, to the switched output 30*a*-3. The switched output 30*a*-3 is in turn connected to a respective load L-30*a*.

Other members of the plurality 30, such as 30*b*, 30*c* out to 30*n* can be connected to respective outputs from the interface element 24 and to respective loads, such as the load L-30*n*. Members of the plurality 32 can be respectively connected to output lines from the plurality 26*b* as well as to respective loads such as the L-32*a* . . . L-32*n*. Similar comments apply to members of the plurality 34 which in turn can be coupled to members of the lines of the output plurality 26*c* as well as respective load members L-34*a* . . . L-34*n*.

The switching elements, members of the pluralities 30, 32, and 34 could be for example implemented as Touch-Plate relay model No. 3000PL or Aromat model No. JT1AG-DC24. Other electromechanical switching elements can be used without departing from the spirit and scope of the present invention.

Figure 2A:
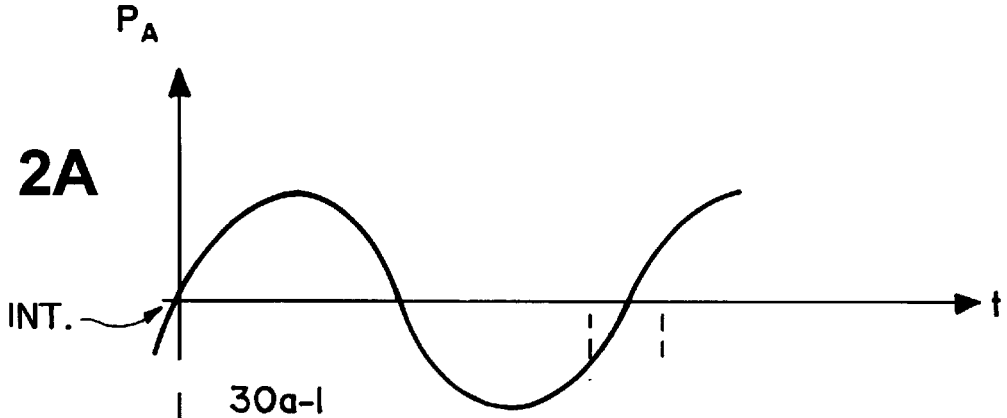
FIG. 2 is a plurality of graphs illustrative of operation of the system of FIG. 1.
Figure 2B:
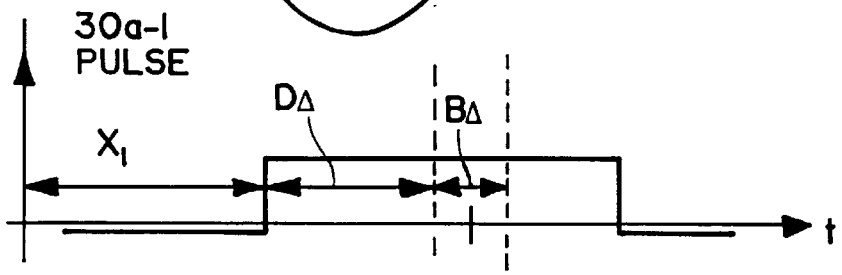
Figure 2C:
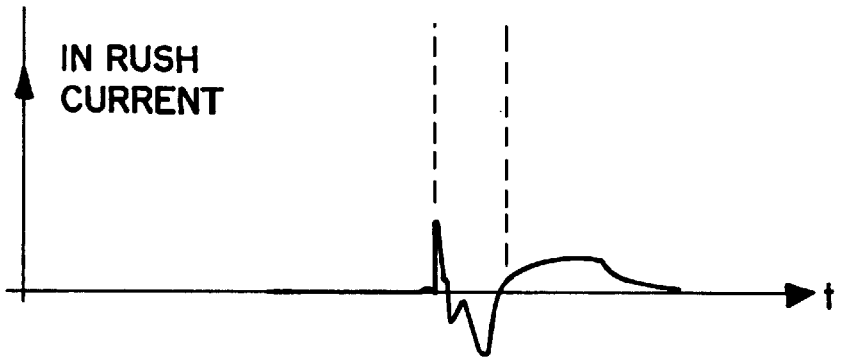

FIG. 2 illustrates various switching wave forms associated with the system 10. FIG. 2(A) illustrates the reference phase, $P_A$, which is in turn coupled to the system 10. For exemplary purposes only, and not by way of limitation, the wave form of FIG. 2(A) is illustrated as a single phase (out of a possible 3 phases) of a 60 hertz AC-type electrical wave form which could be 110 volts RMS or 220 volts RMS without departing from the spirit and scope of the present invention.

FIG. 2B illustrates a contact closing control signal of a type which might be applied to control input 30*a*-1 of switching element 30*a* for the purpose of switching the AC-type electrical energy to the load L-30*a*. As illustrated, and without limitation, the contact closure electrical signal of FIG. 2B is applied for on the order 10 milliseconds for purposes of causing the switching element 30*a*, which could be a relay, to go from an open circuit state between lines 30*a*-2 and 30*a*-3 to a closed circuit state there between. In the closed circuit state, electrical energy is to be provided to the load L-30*a*.

The members of the plurality 30–34, being electromechanical devices, do not change state instantaneously. Rather, there is a delay interval, the device delay $D_\Delta$ associated with each of the switching elements, such as the element 30*a*, between when electrical energy causing that element to change state is applied to the control line 30*a*-1 and when contacts close between the lines 30*a*-2 and 30*a*-3. This delay $D_\Delta$ is illustrated on FIG. 2B.

There is a second parameter which is useful to know with respect to the switching elements 30–34. This parameter, $B_\Delta$, is the contact bounce time during which the respective contacts open circuit and close circuit intermittently before they settle down to a closed circuit condition.

Figure 3:
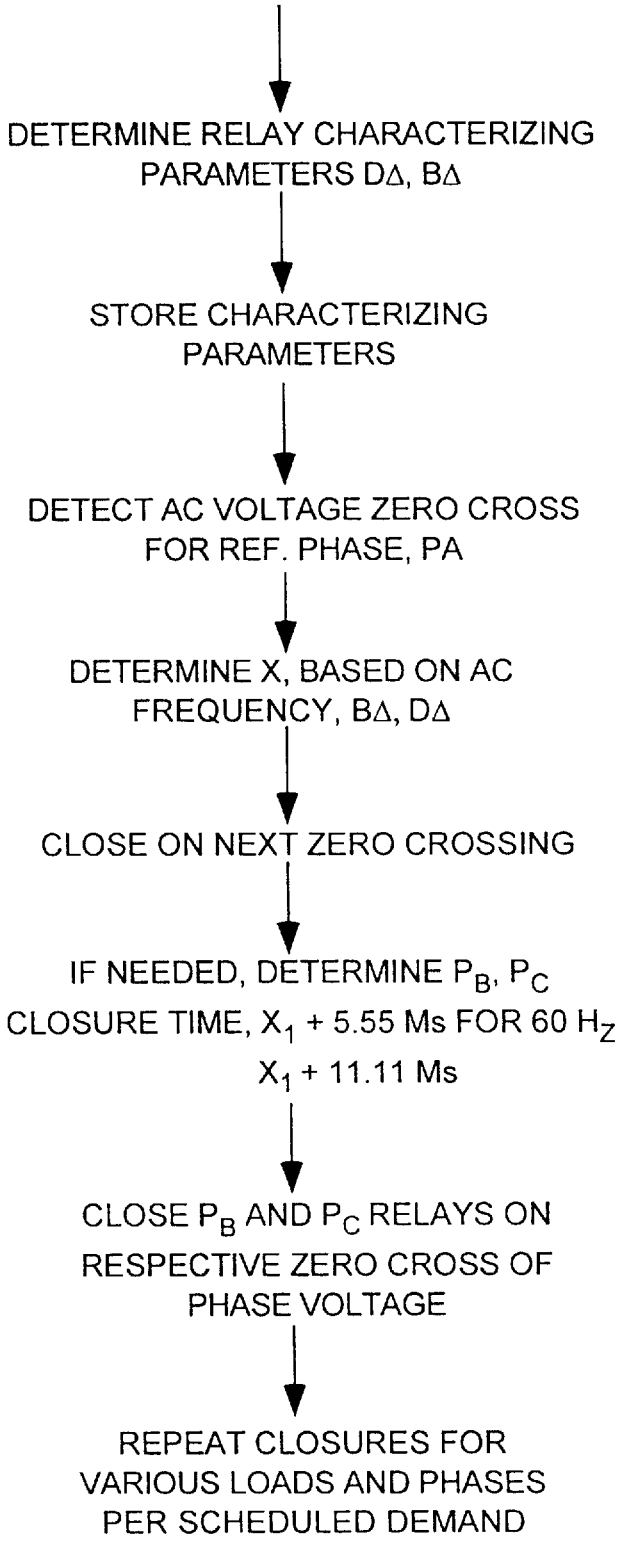
FIG. 3 is a flow diagram of a method implementable by the system of FIG. 1.

In accordance with the graphs of FIG. 2 and the method of FIG. 3, control element 12 stores for subsequent uses, the values of the two parameters, the delay delta $D_\Delta$ and the bounce delta $B_\Delta$. It has been found that each type of switching element useable as a member of the pluralities 30–34 exhibits relatively constant values of the characterization parameters $D_\Delta$ and $B_\Delta$. Using only these two parameters, multi-load, multi-phase zero crossing switching can be carried out. Either a unique set of parameters is stored for each of the switching elements of the pluralities 30–32, or if the elements are all the same type, within normal variations they will, exhibit the same two parameter values for the parameter values $D_\Delta$ and $B_\Delta$. In this case only two parameter values need be stored for all the elements of the pluralities 30–34.

For example and without limitation, the characterization parameters for the two relay models noted above follow:

| | $D_\Delta$ | $B_\Delta$ |
|---|---|---|
| TOUCH PLATE 3000PL | 6 Msec. | 2 Msec. |
| AROMAT MODEL JT1AG-DC246 | 8.9 Msec. | .75 Msec. |

Assuming for the moment that the system 10 incorporates one or the other of the above two noted switching elements, only those two parameter values need be stored, provided all the switching elements are identical.

As illustrated in FIG. 2B the control unit 12, upon sensing a zero crossing on the reference phase $P_A$ and determining a delay time $X_1$ will then energize the switching element 30*a* such that the element 30*a* will close or short circuit lines 30*a*-2 and 30*a*-3 when the next zero crossing occurs which will be centered at the middle of the bounce delay $B_\Delta$. Without further connection to the other phases, namely $P_B$ and $P_C$ corresponding switching elements 32*a* and 34*a* can be switched at respective zero crossings of the respective voltage phase at subsequent times, namely: $X_1$+5.55 MSEC for phase $P_B$ and $X_1$+11.11 MSEC for phase C, $P_C$.

As a result, a system and a method in accordance with the present invention use characterization parameters associated with each of the switching elements, to repeatedly and reliably carry out zero voltage cross-over switching for single phase or three-phase loads as desired. Switching at the zero voltage cross-over point as illustrated in the graphs of FIG. 2 minimizes inrush current making it possible to extend the life of the switching elements and also to use less expensive switching element, which in turn are more cost effective.

From the foregoing, it will be observed that numerous variations and modifications may be effected without departing from the spirit and scope of the invention. It is to be understood that no limitations with respect to the specific apparatus illustrated herein is intended or should be inferred. It is, of course, intended to cover by the appended claims all such modifications as fall within the scope of the claims.

We claim:

1. A system for switching varying voltage and current to at least one load comprising:

an electro-mechanical switching element for coupling a periodic, varying voltage and a varying current to a load;

a control unit coupled to said switching element;

a first circuit coupled to said control unit for storing at least a first parameter of said switching element;

a second circuit, coupled to said control unit, for detecting when one of the varying voltage and the varying current exhibits a zero crossing, wherein said control unit establishes a substantially constant coupling signal at said switching element, to cause same to couple the periodic, varying voltage to the load, and wherein said coupling signal is delayed an amount determined, at least in part, by said stored parameter such that said switching element couples the periodic, varying voltage to the load when that voltage exhibits a subsequent zero crossing.

2. A system as in claim 1 wherein said first parameter corresponds to a delay time interval exhibited by said switching element between when said coupling signal is established at said switching element and said element exhibits a change of state.

3. A method of switching a load comprising the steps of:

determining at least one characterizing parameter of an electro-mechanical switching element;

storing the characterizing parameter;

detecting when a varying voltage exhibits a zero crossing and determining, based on the stored parameter, when the switching element should be energized so as to cause same to couple the voltage to the load when the voltage exhibits a subsequent zero crossing; and energizing the switching element by means of a substantially constant amplitude pulse of a predetermined width.

4. A switching system for switching electrical energy, in the form of varying voltage and current, to at least one load, the system comprising:

an electromechanical load switching element having a control input port, an energy input port, and a switched output port;

means for storing at least one switching parameter of said switching element;

a programmed control unit, coupled to said switching element and said storing means; and a zero crossing detector, coupled to said control unit, wherein said detector produces a zero crossing, output signal indicative of a zero crossing of the varying voltage and wherein said control unit generates a substantially constant amplitude switching signal at said control input port to couple energy at said energy input port to said switched output port, wherein generation of said switching signal is off-set from said zero crossing output signal an amount related at least to said one switching parameter.

5. A switching system as in claim 4 wherein said means for storing includes a second switching parameter of said switching element and wherein generation of said switching signal is off-set from said zero crossing output signal an amount related to said two switching parameters.

6. A circuit for switching AC electrical signals at a voltage zero crossing comprising:

an electro-mechanical relay with at least one control input and first and second relay contacts wherein the relay contacts mechanically close after a first interval and substantially cease bouncing after a second time interval after the application of an applied control signal thereby producing a bounce free closed circuit therebetween;

an electronic storage element for storing a representation of at least the first time interval;

an AC voltage sensor coupled to one of the relay contacts for sensing an applied AC voltage to be switched;

a control circuit coupled to the control input, the storage element and the sensor for monitoring the applied AC voltage and wherein the control circuit supplies the control signal to the control input at a time which precedes the zero crossing of that AC voltage by a time interval corresponding to the sum of the first and one-half of the second time intervals when the sensed AC voltage exhibits substantially a zero amplitude to thereby switch the AC electrical signals.

7. A circuit as in claim 6 wherein the control circuit includes further circuitry for supplying a substantially constant amplitude control signal to the control input.

8. A multiple phase AC switching system wherein each phase is offset from an adjacent phase a predetermined, common amount, comprising:

a plurality of electromechanical switching devices wherein the members of the plurality are substantially identical and each member includes a control input and at least first and second switchable metallic conductors wherein the conductors engage one another to provide a metallic conductive path therebetween in response to a selected control signal being applied to the input port and wherein each member is associated with a respective one of the phases of AC and wherein one of the switchable conductors is couplable to the respective phase of the AC;

a voltage sensor couplable to a selected one of the AC phases;

a control unit coupled to the sensor, to the control input of each of the switching devices and couplable to the selected phase wherein the control unit includes storage of a common turn-on characteristic for each of the switching devices wherein the characteristic establishes a selected time interval between when a respective control signal is applied to a respective switching device and the respective conductors provide a substantially bounce free conductive path therebetween and wherein the control unit includes circuitry for switching each of the AC phases at a respective voltage zero crossing by first energizing the control input of the switching device coupled to the selected one of the AC phases, before that phase exhibits a voltage zero crossing by an amount corresponding to the selected time interval and by the energizing the control input of each of the remaining switching devices at time intervals corresponding to the offset between the phases.

9. A system for switching varying voltage and current to at least one load comprising:

an electro-mechanical switching element for coupling a periodic, varying voltage and a varying current to a load;

a control unit coupled to said switching element;

a first circuit coupled to said control unit for storing first and second parameters of said switching element;

a second circuit, coupled to said control unit, for detecting when one of the varying voltage and the varying current exhibits a zero crossing, wherein said control unit establishes a coupling signal at said switching element, to cause same to couple the periodic, varying voltage to the load, and wherein said coupling signal is delayed an amount determined, at least in part, by said stored parameters such that said switching element couples the periodic, varying voltage to the load when that voltage exhibits a subsequent zero crossing;

wherein said first parameter corresponds to a delay time interval exhibited by said switching element between when said coupling signal is established at said switching element and said element exhibits a change of state and wherein said second parameter corresponds to a contact bounce interval.

10. A system as in claim 9 wherein digital representations of said parameters are stored in said circuit for storing.

11. A system as in claim 9 wherein said coupling signal is delayed an amount determined, at least in part, by both of said parameters.

12. A multiple phase AC switching system wherein each phase is offset from an adjacent phase a predetermined, common amount, comprising:

a plurality of electro-mechanical switching devices wherein the members of the plurality are substantially identical and each member includes a control input and at least first and second switchable metallic conductors wherein the conductors engage one another to provide a metallic conductive path therebetween in response to a selected control signal being applied to the input port, wherein each member is associated with a respective one of the phases of AC and wherein one of the switchable conductors is couplable to the respective phase of the AC;

a sensor couplable to a selected one of the AC phases;

a control unit coupled to the sensor, to the control input of each of the switching devices and couplable to the selected phase wherein the control unit includes storage of a common turn-on characteristic for each of the switching devices wherein the characteristic establishes a selected time interval between when a respective substantially constant amplitude control signal is applied to a respective switching device and the respective conductors provide a substantially bounce free conductive path therebetween and wherein the control unit includes circuitry for switching each of the AC phases at a respective voltage zero crossing by first energizing the control input of the switching device coupled to the selected one of the AC phases, before that phase exhibits a voltage zero crossing by an amount corresponding to the selected time interval and by the energizing the control input of each of the remaining switching devices at time intervals corresponding to the offset between the phases.

13. A multiple phase AC switching system wherein each phase is offset from an adjacent phase a predetermined, common amount, comprising:

a plurality of electro-mechanical switching devices wherein the members of the plurality are substantially identical and each member includes a control input and at least first and second switchable metallic conductors wherein the conductors engage one another to provide a metallic conductive path therebetween in response to a selected control signal being applied to the input port, wherein each member is associated with a respective one of the phases of AC and wherein one of the switchable conductors is couplable to the respective phase of the AC;

a sensor couplable to a selected one of the AC phases;

a control unit coupled to the sensor, to the control input of each of the switching devices and couplable to the selected phase wherein the control unit includes storage of a device conductor closure delay interval and a device contact bounce interval and wherein the control unit includes circuitry for switching each of the AC phases at a respective voltage zero crossing by first energizing the control input of the switching device coupled to the selected one of the AC phases, before that phase exhibits a voltage zero crossing by an amount proportional to the closure delay interval and the bounce interval and by the energizing the control input of each of the remaining switching devices at time intervals corresponding to the offset between the phases.

14. A system as in claim 13 wherein the control unit includes circuitry for storing a closure delay interval value and a contact bounce interval.

15. A system as in claim 13 wherein the control unit includes circuitry for generating a substantially constant amplitude control signal.

16. A system as in claim 15 wherein the circuitry for generating includes further circuitry for producing a substantially constant amplitude pulse of a width corresponding to a sum of the closure delay interval and a value in a range of forty to sixty percent of the contact bounce interval.

17. A method of switching a phase of a load using an electro-mechanical switch with first and second output contacts comprising the steps of:

determining a contact closure time interval for the switch;

detecting when a varying voltage to be coupled to the load exhibits a zero crossing and establishing a leading offset interval, based on the closure time interval, when the switch should be energized so as to cause the output contacts to couple the voltage to the load when the voltage exhibits a subsequent zero crossing; and energizing the switch in response to the determining step to close the output contacts, at the next zero crossing by coupling a constant amplitude control signal thereto.

18. A method as in claim 17, wherein multiple phase applied varying voltages can be switched at respective zero crossings by combining at least one phase related delay interval with the offset interval.

* * * * *